United States Patent [19]

Smith

[11] Patent Number: 4,583,482

[45] Date of Patent: Apr. 22, 1986

[54] SIGNAL INDICATOR

[76] Inventor: Faye M. Smith, Eagle Rock, N.C. 27523

[21] Appl. No.: 694,503

[22] Filed: Jan. 24, 1985

[51] Int. Cl.[4] ..... G09F 17/00

[52] U.S. Cl. ..... 116/209; 116/173; 40/610; 40/617

[58] Field of Search ..... 116/209, 173, 174, 175, 116/319, 323, 328, 47, DIG. 6; 40/585, 607, 610, 612, 617; 248/512, 513, 530–533, 542; 52/40; D10/65; D3/1–4; 206/45.15

[56] References Cited

U.S. PATENT DOCUMENTS

| | | | |
|---|---|---|---|
| 1,228,092 | 5/1917 | Brewer | 116/173 |
| 1,312,426 | 8/1919 | Schmidt | 116/173 |
| 1,626,913 | 5/1927 | Brown | 116/173 |
| 1,649,249 | 11/1927 | Newman | 40/207 |
| 2,756,526 | 7/1956 | Stein et al. | 40/610 |
| 2,881,543 | 4/1959 | De Rouen | 40/607 |
| 3,225,734 | 12/1965 | Bule | 116/173 |
| 4,375,134 | 3/1983 | Sheetz | 116/173 |

*Primary Examiner*—Charles Frankfort
*Assistant Examiner*—Patrick R. Scanlon
*Attorney, Agent, or Firm*—Mills and Coats

[57] ABSTRACT

A portable ground insert signal indicator designed to be utilized by an individual to indicate his or her presence in a wooded or forested area and to direct others to his or her location. The signal indicator of the present invention comprises an elongated stake having a flag attached to an upper end portion thereof and a directional indicator pivotably attached to an intermediate portion of the stake. Also provided is a sleeve axially movable on said stake and movable between a closed position where the same encompasses and encloses the directional indicator and said flag and an open position where said directional indicator and said flag are exposed.

5 Claims, 3 Drawing Figures

SIGNAL INDICATOR

FIELD OF INVENTION

The present invention relates to signaling and indicating devices and more particularly to signaling and indicating devices of the ground insert type used to indicate the presence of individuals in certain areas.

BACKGROUND OF INVENTION

Since man first began to congregate and form cities, he has looked towards the widerness areas for many of his recreational needs. Today, due to the growing complexity of our society, the popularity of outdoor recreational activities such as hunting, fishing, camping, etc., has exploded. The relative isolation caused by such activities is not without its difficulties. For instance, a friend may wish to join another who has previously entered a wooded or forested area to hunt. However, the person is then presented with the problem of locating his friend who has previously entered the wooded area. This problem of location can become crucial if an emergency arises with the person who had first entered the wooded area.

SUMMARY AND OBJECTS OF THE INVENTION

After much consideration of the foregoing problems, the applicant has invented a structure and method of locating a person who has previously entered a wooded or forested area. The structure comprises a stake having a flag attached to its upper end and a directional indicator pivotably mounted to an intermediate portion of said stake. Also provided is a sleeve slidingly mounted on said stake-like member and movable between a closed position where the same can encompass and enclose said directional indicator and said flag, and an open position where said directional indicator and said flag are exposed.

It is, therefore, an object of the present invention to provide a multi-purpose portable stake-like means for indicating an individual's presence in a wooded or forested area.

It is also an object of the present invention to provide a directional indicator with said stake-like means to indicate the direction which the individual proceeds from relative to said stake-like manner.

Another object of the present invention is to provide flag means attached to said stake-like means for attracting attention to said stake-like means.

It is yet another object of the present invention to provide sleeve means slidingly mounted on said stake-like means for enclosing and encasing said directional indicator and said flag means when said stake-like means is not in use.

A further object of the present invention is to provide a lightweight portable signal indicator of the character referred to above that is simple in design, easy to handle and carry, easy to manufacture, and relatively inexpensive.

Other objects and advantages of the present invention will become apparent from a study of the following description and the accompanying drawings which are merely illustrative of such invention.

DETAILED DESCRIPTION OF PRESENT INVENTION

With further reference to the drawings, the signal indicator of the present invention is shown therein and indicated generally by the numeral 10. Signal indicator 10 is of a lightweight portable construction which enables a group of the same to be easily and conveniently carried by an individual.

Figure 3:
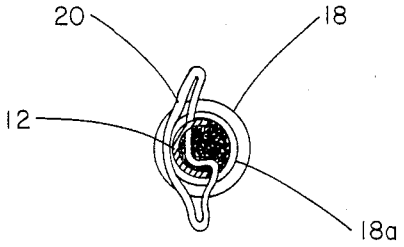
FIG. 3 is a sectional view taken through the line 3—3 of FIG. 1.

Viewing said signal indicator 10 in more detail, it is seen that the same includes a generally elongated stake 12 that as seen in FIG. 3 is of a generally U-shaped cross section which provides strength and rigidity to the signal indicator and which further tends to prevent the same from easily turning and rotating once inserted in the ground. Stake 12 includes an upper end portion **12*a* and a lower ground insert portion 12*b*. It is noted that lower ground insert portion 12*b*** includes a tapered end that allows the same to be easily inserted within the ground.

Secured to upper end portion **12*a* is a flag 14. Flag 14** is preferably constructed of a suitable type of plyable material such as cloth.

Secured to stake 12 below flag 14 is a direction indicator arm 16. Direction indicator arm 16 is pivotably mounted to stake 12 by a pivot pin 22. The provision of pivot pin 22 allows the direction indicator arm 16 to pivot from an inoperative position where the same extends along and adjacent stake 12 (FIG. 2) to an operative indicating position shown in FIG. 1.

Secured intermediately on stake 12 is a stop 20. Movably mounted axially along stake 12, above stop 20, is a sleeve 18. Sleeve 18 is of a generally cylindrical construction and is designed to extend around said stake 12 and is adapted to move upwardly and downwardly on stake 12 between the upper end portion **12*a* and stop 20. Sleeve 18** could be constructed of a plastic material.

Formed about the lower portion of sleeve 18 is a smaller sleeve extension **18*a* that is designed to frictionally engage stake 12 and in going so acts to hold the sleeve 18 about the stake 12** at various positions along the stake.

Figure 1:
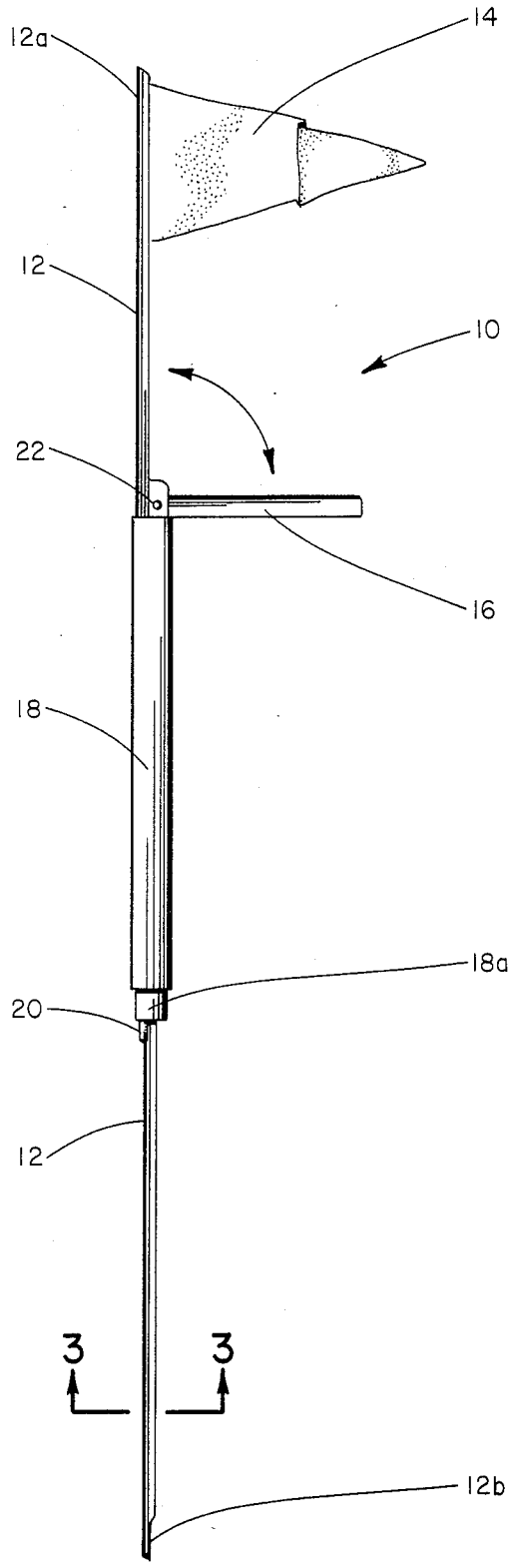
FIG. 1 is a side elevational view of the signal indicator of the present invention shown in the open operative position.
Figure 2:
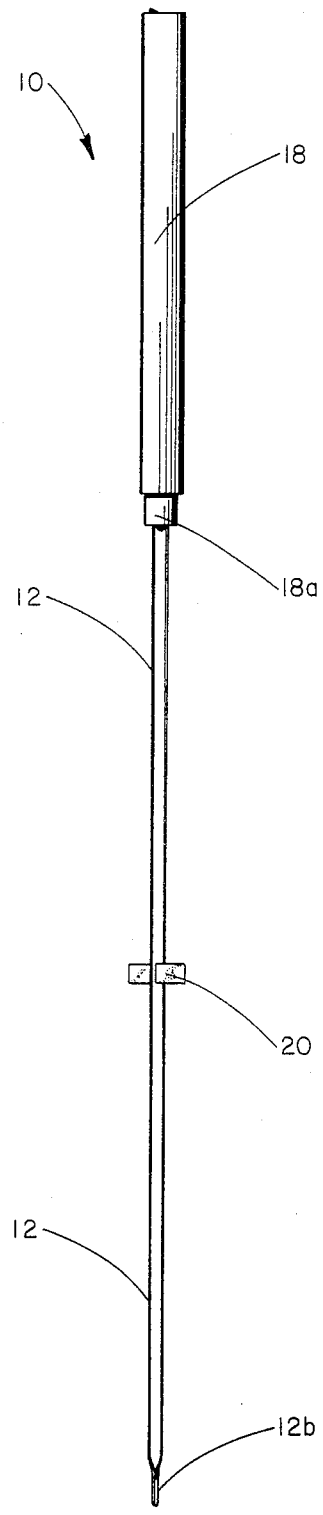
FIG. 2 is a side elevational view of the present invention shown in a closed inoperative position with the sleeve thereof raised to a closed position where the same encloses the flag and direction indicator of the device of the present invention.

As noted hereinbefore, sleeve 18 is designed to move between an open operative position as shown in FIG. 1 to a closed inoperative position as shown in FIG. 2. In the operative open position as shown in FIG. 1, it is seen that the sleeve is precisely disposed between stop 20 and the direction indicator 16. It should be pointed out that the upper end or edge of sleeve 18 actually engages and supports the direction indicator 16 in operative pointing position.

When not in use, sleeve 18 is moved upwardly on stake 12 to where it assumes the closed inoperative position as shown in FIG. 2. The interior of sleeve 18 is hollow and open in order that the same can surround and receive stake 12 and also receive flag 14 and direction indicator 16.

It is, therefore, appreciated that sleeve 18 can be freely and conveniently moved back and forth between the open and closed positions discussed above.

In use the signal indicator 10 of the present invention has many uses. For example, an individual that is contemplating entering the woods or a certain area for hunting, hiking or for any other reason, can position the indicator 10 adjacent the wooded area where he or she is to enter. The entire signal indicator 10 can be oriented within the ground such that the position indicator 16 is directed in the direction that the individual enters the particular area. Therefore, the person trying to locate that individual that has entered an area can determine the point of entry and the general direction taken by the individual entering that area.

It should be pointed out that for safety and other reasons that flag 14 could preferably be of a fluorescent color such as a hunter's orange. This would make the flag 14 and the signal indicator of the present invention easier to see and detect. In addition it is contemplated that the sleeves 18 would be color coded in order that certain indicators could be used for one purpose while others could be used for another purpose. In addition it is contemplated that the respective sleeves 18 could be provided with a tape or some other suitable material whereby an individual's name could be inscribed or printed thereon. This would assist in preventing one individual from removing indicators belonging to another individual and would also assist one person trying to locate or follow another certain individual. Essentially this would eliminate any possible confusion.

There are many other uses for the signal indicator 10 of the present invention. In the way of examples, signal indicator 10 can be placed in spaced apart locations along a trail in order to lead an individual from one point to another. This can be extremely helpful for an individual that is unacquainted with a certain wooded area and desires to be assured that he or she can find the way back to a certain location.

Therefore, from the foregoing specification and discussions, it is appreciated that the signal indicator 10 of the present invention can be used in a wide variety of ways especially by individuals who participate in outdoor activities such as hunting, camping, backpacking and the like. The signal indicator 10 of the present invention has the advantage of being relatively small, portable, lightweight and as such, it is appreciated that a group or bunch of these signal indicators can be conveniently carried and hand-held by one individual.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A portable lightweight ground insert signal indicator for use by hunters, outdoorsmen and other individuals to indicate an area where such individuals can be found, said portable lightweight ground insert signal indicator comprising:

an elongated generally U-shaped stake having an upper end portion and a pointed lower ground insert portion;

a flag secured to the upper end portion of said generally U-shaped stake;

a stop secured to said generally U-shaped stake intermediately between said upper portion and said lower ground insert portion;

a direction indicator secured to said stake intermediately between said stop and the upper end portion of said stake;

means for pivotably mounted said direction indicator for movement between an inoperative position where said direction indicator extends adjacent and along side said stake to an indicating position where said indicator projects outwardly from said stake and points in a direction in which individuals can be found;

an elongated sleeve movably mounted for axial movement on said stake between said stop and the upper end portion of said stake; and said sleeve being movably mounted for movement from a closed inoperative position about the upper end portion of said stake where said sleeve covers and encases said flag and said direction indicator to an open portion where said sleeve abuts said stop and where said flag and direction indicator are exposed.

2. The portable lightweight ground insert signal indicator of claim 1 wherein said sleeve includes an upper edge that engages and supports said direction indicator in said indicating position when said direction indicator assumes said indicating position and when said sleeve assumes said open operative position; and wherein said direction indicator extends generally normal with respect to said stake when the direction indicator assumes said indicating position.

3. The portable lightweight ground insert signal indicator of claim 2 wherein said sleeve includes a plastic cylindrical member having an opening extending completely therethrough for receiving said stake.

4. The portable lightweight ground insert signal indicator of claim 3 wherein said sleeve includes a lower sleeve extension for functionally engaging said stake and effectively stationing said sleeve on said stake.

5. A ground insert stake type signaling device comprising: an elongated stake having an upper end portion and a lower ground insert end; flag means secured to the upper end portion of said stake; a sleeve axially movable on said stake from a closed inoperative position to an open operative position; said sleeve in said closed inoperative position assuming a position about the upper end portion of said stake where said sleeve confines said flag means within said sleeve; and wherein in said open operative position said sleeve assumes a position spaced downwardly on said stake from said flag means such that said flag means is exposed and not confined within said sleeve; a direction indicator pivotably mounted to said stake and movable from an inoperative position where the direction indicator extends adjacent and along beside said stake and is confined by said sleeve when in the inoperative position to an operative indicating position where the direction indicator is released from said sleeve and projects outwardly from said stake; and stop means secured intermediately on said stake for limiting the movement of said sleeve and for establishing said open operative position as said sleeve is prevented from moving further downwardly on said stake.

* * * * *